US006884010B1

(12) United States Patent
Hosier et al.

(10) Patent No.: US 6,884,010 B1
(45) Date of Patent: Apr. 26, 2005

(54) APPARATUS FOR SCORING COVE MOLDINGS

(76) Inventors: Jeffrey Hosier, 12 Michael Rd., Binghamton, NY (US) 13901; Christopher Decker, 1426 River Rd., Binghamton, NY (US) 13901; David Decker, 821 Main St., Vestal, NY (US) 13850

( * ) Notice: Subject to any disclaimer, the term of this patent is extended or adjusted under 35 U.S.C. 154(b) by 0 days.

(21) Appl. No.: 10/438,627

(22) Filed: May 16, 2003

(51) Int. Cl.[7] ..... B23C 1/020

(52) U.S. Cl. ..... 409/182; 409/178; 409/175; 144/136.1; 144/136.95

(58) Field of Search ..... 409/178, 175, 409/181, 182; 144/136.1, 136.95, 154.5, 371; 83/875, 876, 877, 879, 880

(56) References Cited

U.S. PATENT DOCUMENTS 5,203,389 A * 4/1993 Goodwin ..... 409/182
5,285,831 A * 2/1994 Woolgar ..... 144/136.95
5,533,556 A * 7/1996 Whitney ..... 144/144.1
5,630,455 A * 5/1997 Julien ..... 144/136.95
5,738,470 A * 4/1998 Sugita ..... 409/182
6,039,095 A * 3/2000 Newman ..... 409/130
6,068,036 A * 5/2000 Cassidy ..... 144/134.1
6,116,304 A * 9/2000 Wilson et al. ..... 144/154.5
6,138,372 A * 10/2000 Newman ..... 409/181
6,374,878 B1 * 4/2002 Mastley et al. ..... 409/182
6,481,477 B1 * 11/2002 Szymanski et al. ..... 144/371
6,491,072 B1 * 12/2002 Pikna ..... 409/89

* cited by examiner

*Primary Examiner*—A. L. Wellington
*Assistant Examiner*—Dana Ross
(74) *Attorney, Agent, or Firm*—Mark Levy & Associates

(57) ABSTRACT

A scoring apparatus for placing a scoring line on a back surface of a piece of vinyl or rubber cove molding, in order to easily conform the molding about sharp corners. The scoring apparatus uses a frame for pivotally supporting a router between an inoperative position and a work engaging position. The router is mounted on a base that slides within a slot in the frame so that it can be drawn across the cove molding to provide the scoring line.

8 Claims, 5 Drawing Sheets

APPARATUS FOR SCORING COVE MOLDINGS

FIELD OF THE INVENTION

This invention relates to scoring tools and, more particularly, to an apparatus for placing a scoring line on a back surface of cove molding, in order to easily conform the cove molding about sharp corner bends in wall surfaces.

BACKGROUND OF THE INVENTION

In the art of building construction, cove molding is often used to decorate, protect, and give a finished appearance along the bottom of walls and exposed surfaces. One of the major problems with the use of vinyl or rubber cove molding is its inability to follow sharp bends or curves in the walls. Often, the vinyl or rubber molding will pull away from its adhesive around sharp corners. This necessitates constant regluing.

It is known to place a score line on the back surface of the molding in order to provide a means by which the molding will conform to a sharp bend in a wall. The difficulty with making a scoring line in soft material, such as rubber or vinyl, is that quite often the knife blade sinks, or is driven too far into the material. The cove molding will then be too weak to be applied about the corner without physically ripping or showing the line where the cut took place. On the other hand, if the score line is not made deep enough, the material will not appreciably conform to a bend. Applying a score line by hand often produces a score line that is uneven, i.e., it is too deep in some spots and not deep enough in other spots along the line axis.

The present invention provides an apparatus for making a uniform score line in cove molding that is precisely at the proper depth to effect a sharp bend.

The current invention comprises an apparatus that houses a router for scoring vinyl or rubber cove molding. The router is supported upon a base that is movable within an internal slot disposed in two spaced apart longitudinal beams. Two transversely placed beams hold the spaced apart beams together at their distal ends, thus forming a frame. Two spaced apart blocks are juxtaposed at one end of the frame. The two spaced apart blocks support a shaft that runs through the longitudinal beams at one of their distal ends.

The frame is pivotal about the shaft. The router, which is supported upon the longitudinal beams, is pivotally lowered into engagement with a piece of cove molding. There are index marks on the plate for lining up the work. The router produces a score line in the cove molding by moving the router longitudinally within the internal slot of the longitudinal beams. The height of the router above the surface of the cove molding is adjustable by a turn screw that is disposed in a vertical slot in the router sheath. The frame is spring biased about its pivotal end to an inoperative position. Pushing down on the frame, the molding is clamped down to a table, bringing the router into contact with the surface of the cove molding. Drawing the router across the longitudinal beams via said internal slot will produce the required score line.

DISCUSSION OF RELATED ART

There are many apparatuses for supporting cutting blades, tools, or routers. To the best of our knowledge and belief, none of the router supporting apparatuses provide a spring biased hinge mechanism that allows the router to move into exact engagement with a piece of work to be scored.

SUMMARY OF THE INVENTION

In accordance with the present invention, an apparatus is provided that houses a router for scoring vinyl or rubber cove molding. The scoring is necessary to provide a means by which the cove molding can conform to sharp bends in walls and other structures. The router is supported upon a base that is movable within an internal slot disposed within two spaced apart longitudinal beams of the apparatus.

Two transversely placed beams hold the spaced apart beams together at their distal ends, thus forming a frame. Two spaced apart blocks are juxtaposed at one end of the frame. The two spaced apart blocks support a shaft that runs through the longitudinal beams at one of their distal ends. The frame is pivotal about the shaft. The router, which is supported upon the longitudinal beams, is pivotally lowered into engagement with a piece of cove molding.

The router produces a score line in the cove molding by moving the router longitudinally across the longitudinal beams via the internal slot. The height of the router above the surface of the cove molding is adjustable by a turn screw that is disposed in a vertical slot in the router sheath. The frame is spring biased about its pivotal end to an inoperative position. Pushing down on the frame, the molding is clamped down to a table, bringing the router into exact contact with the surface of the cove molding. Then, drawing the router across the longitudinal beams through said internal slot will produce the required score line.

It is an object of this invention to provide an improved apparatus for creating a score line in cove molding.

It is another object of the invention to provide a router support apparatus that allows for a precise scoring line to be formed in a piece of cove molding.

BRIEF DESCRIPTION OF THE DRAWINGS

A complete understanding of the present invention may be obtained by reference to the accompanying drawings, when considered in conjunction with the subsequent detailed description, in which.

Figure 1:
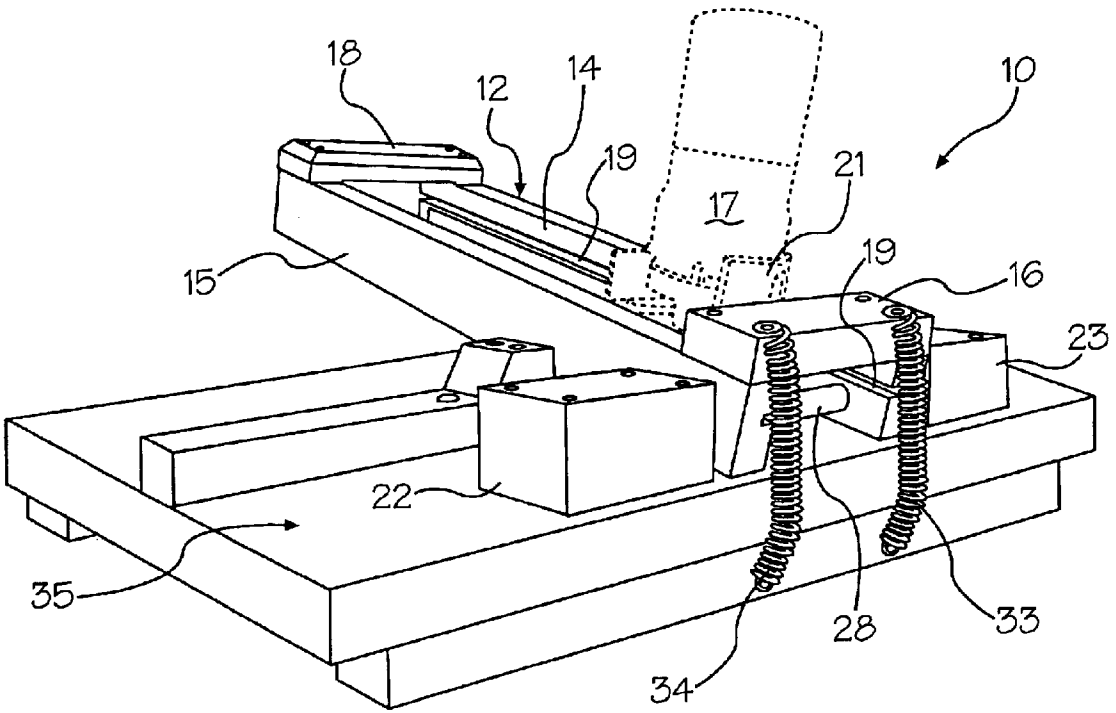
FIG. 1 illustrates a perspective view of the left side of the scoring apparatus of this invention in its initial, inoperative state.

For purposes of brevity and clarity, like components and elements of the apparatus of this invention will bear the same designations or numbering throughout the figures.

DESCRIPTION OF THE PREFERRED EMBODIMENT

Generally speaking, there is featured a scoring apparatus for placing a scoring line on a back surface of a piece of vinyl or rubber cove molding, in order to easily conform the molding about sharp corners. The scoring apparatus comprises a frame for pivotally supporting a router between an inoperative position and a work engaging position. The router is mounted on a base that slides within a slot in the frame so that it can be drawn across the cove molding to provide the scoring line.

Now referring to FIGS. 1 through 5, the scoring apparatus 10 of this invention is illustrated. The apparatus 10 comprises a wooden frame 12 comprised of two longitudinally parallel beams 14 and 15, respectively. Two transverse beams 16 and 18 hold the longitudinal beams 14 and 15 together, thus forming a frame 12. The frame 12 is supported upon a table 35. The two transverse beams 16 and 18 support a router 17 that can slide along the longitudinally parallel beams 14 and 15 by reason of internal slots 19, each of which run along the inner surface and longitudinal axis of the beams 14 and 15.

Figure 2:
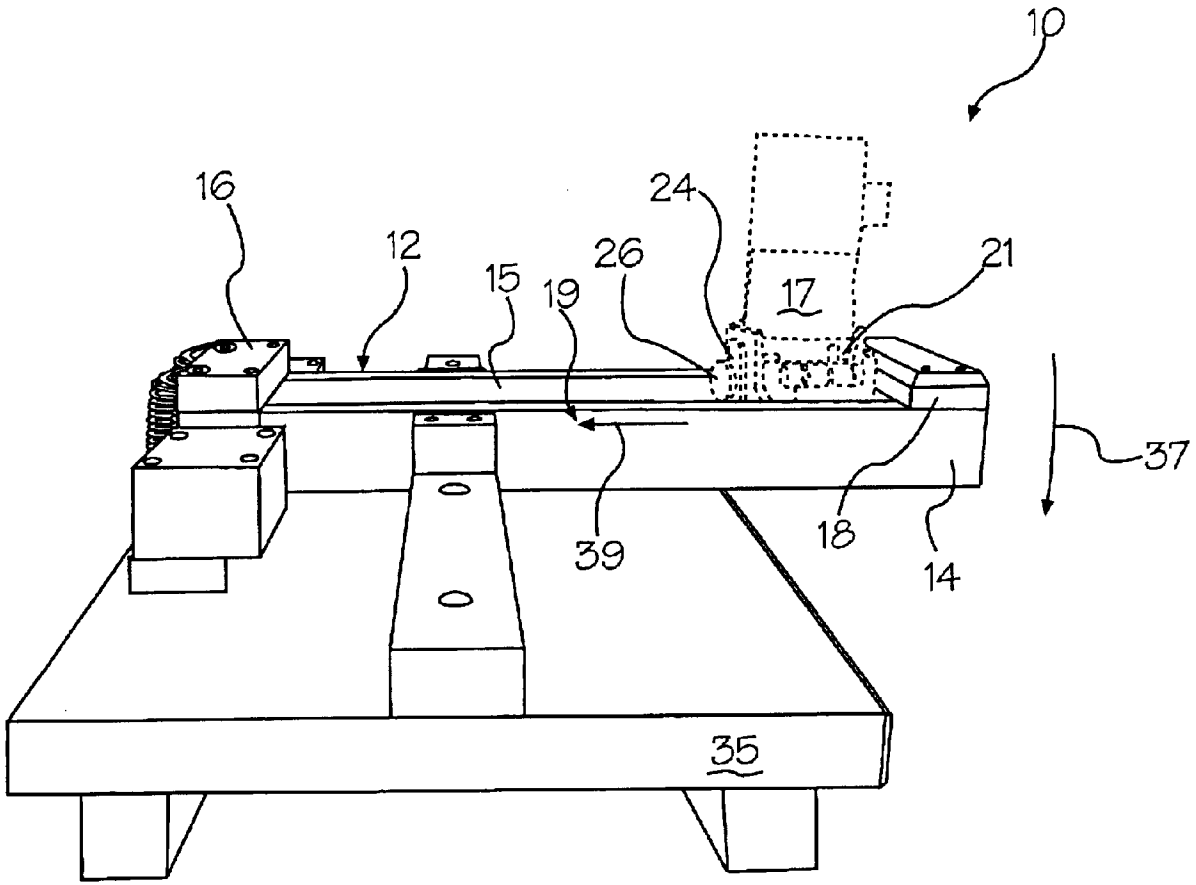
FIG. 2 depicts a perspective view of the right side of the scoring apparatus of FIG. 1, with the frame and router lowered to engage the cove molding.
Figure 3:
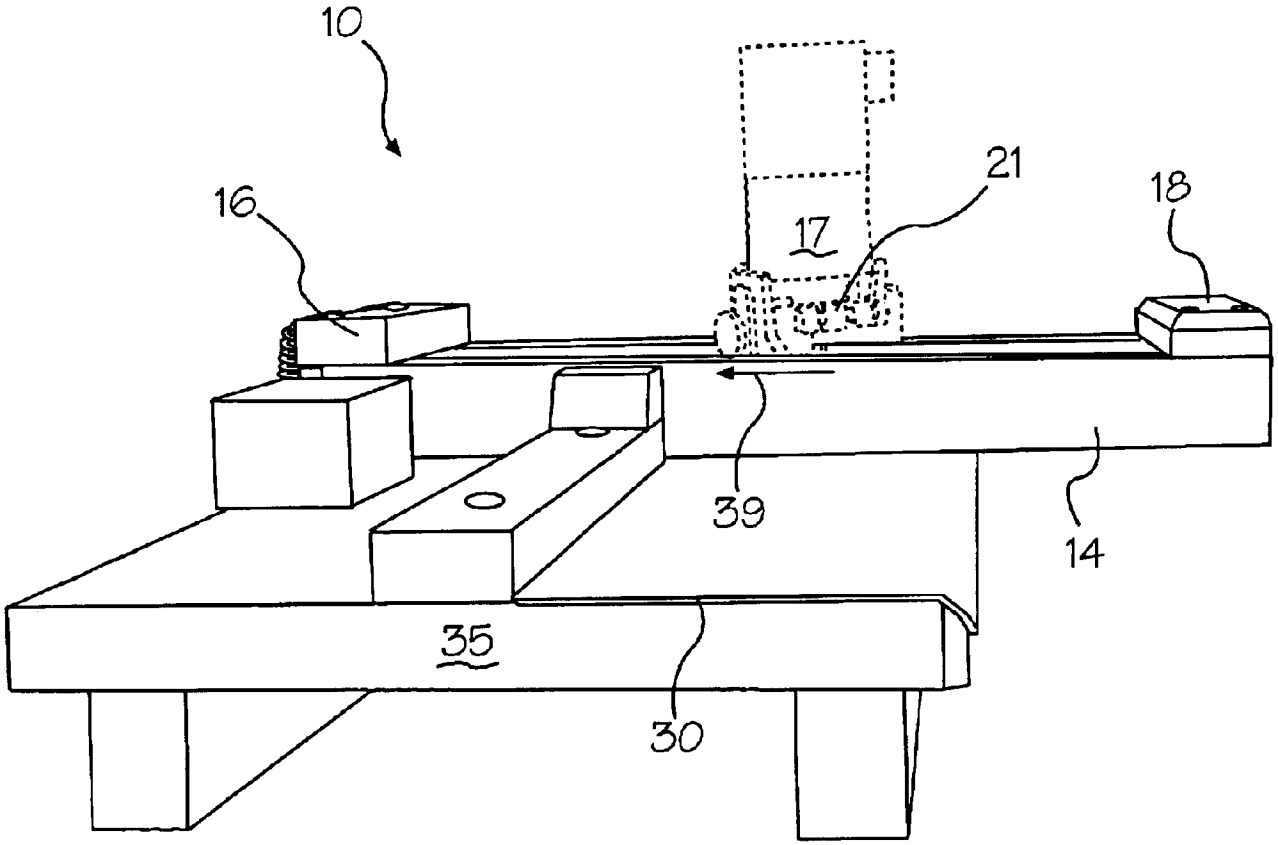
FIG. 3 shows a perspective view of the left side of the apparatus of FIG. 1, with the router being moved across the surface of the cove molding to provide a score line therein.
Figure 4:
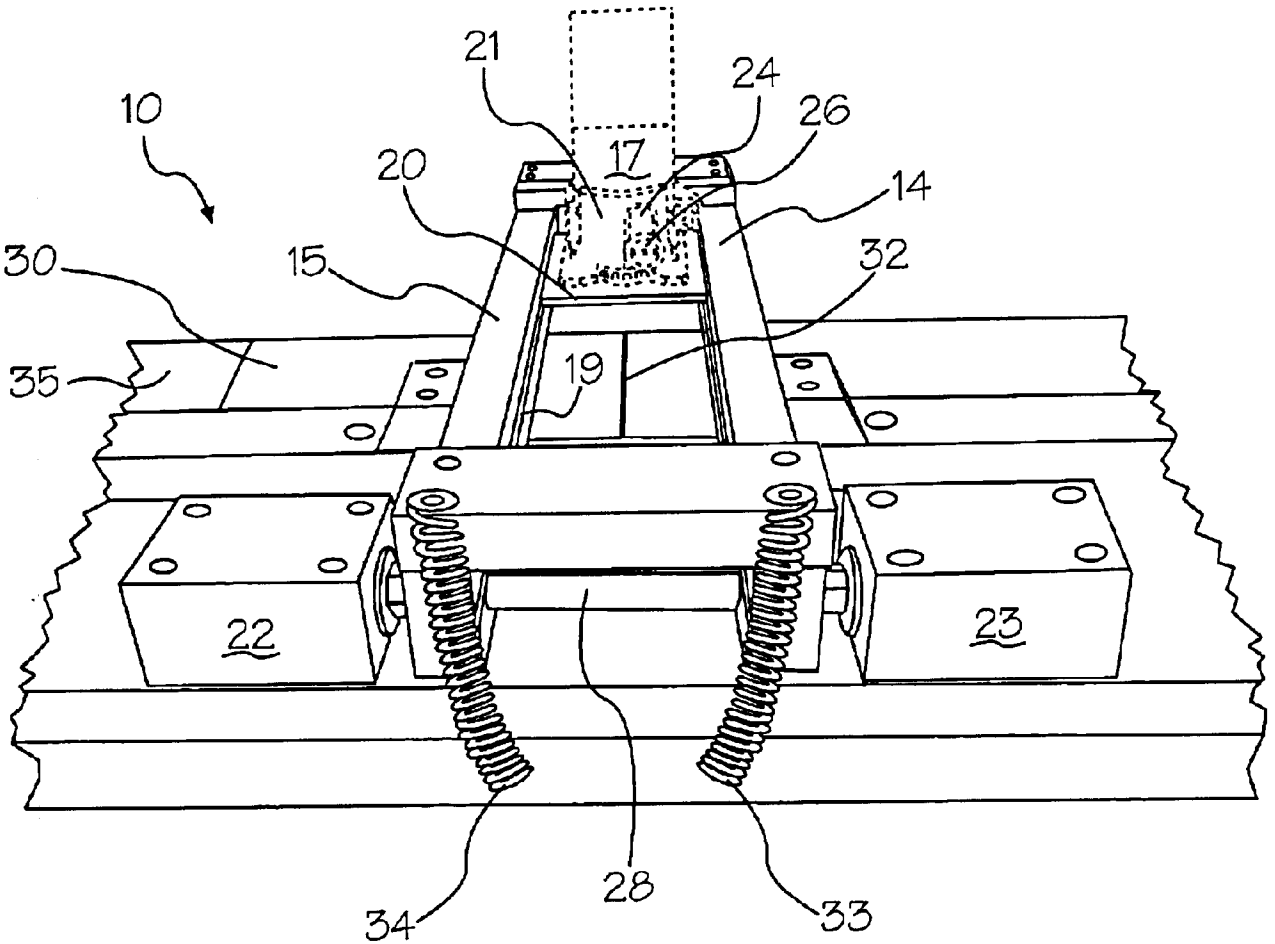
FIG. 4 illustrates a perspective view of the back of the apparatus of FIG. 1, with the router having placed a score line in the cove molding.

The router 17 is supported upon a flat base 20, which is slidably disposed within the slot 19, thus allowing the router 17 to slide with respect to beams 14 and 15. A sheath 21 extends upwardly from the base 20, and comprises a slot 24 and a turn screw 26, as best seen in FIGS. 2 and 4. The height of the router 17 can be adjusted with respect to the base 20 by moving the router 17 up and down within the slot 24 and then fixing its height position by tightening the turn screw 26.

A pair of anchor blocks 22 and 23 straddle the frame 12 on its distal end. The anchor blocks 22 and 23 support a shaft 28 that passes through the longitudinal beams 14 and 15, as best observed with reference to FIGS. 1 and 4. The beams 14 and 15 are pivotal about the shaft 28.

A pair of coil springs 33 and 34 bias the pivotal movement of the frame 12 about the shaft 28. Each of the springs 33 and 34 are attached to the transverse beam 16 and to the underside of the table 35, as best seen in FIGS. 1 and 4. The router 17 is fitted with a cone-shaped bit.

DETAILED DESCRIPTION OF THE PREFERRED EMBODIMENT

Figure 5:
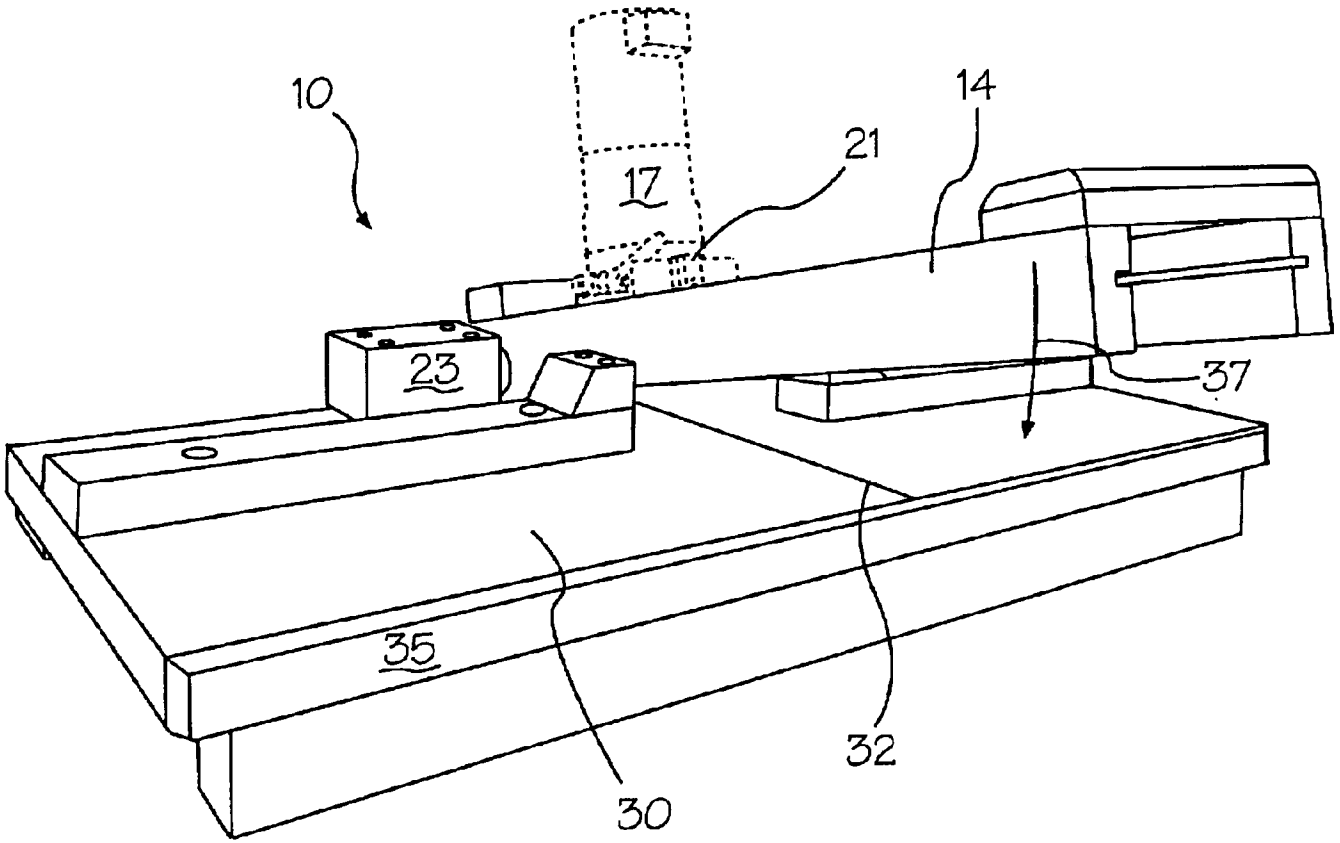
FIG. 5 depicts a perspective view of the right side of the scoring apparatus in its final operative position.

Referring to FIG. 1, the apparatus 10 is shown in its initial, inoperative position. A piece of vinyl or rubber cove molding 30 to be scored is placed on the table 35, as best observed with reference to FIG. 3. The frame 12 is then pivoted downwardly, as shown in FIG. 2, arrow 37. The router 17 containing the cone-shaped bit is then moved longitudinally along the longitudinal beams 14 and 15, as shown by arrow 39, until it reaches the opposite end of the frame 12, as shown in FIG. 4. A score line 32 having the proper depth in the cove molding piece 30 has been made, as best observed in FIGS. 4 and 5. The frame 12 is then released (arrow 40) from its biased position, as shown in FIG. 5.

Since other modifications and changes varied to fit particular operating requirements and environments will be apparent to those skilled in the art, the invention is not considered limited to the example chosen for purposes of disclosure and covers all changes and modifications which do not constitute departures from the true spirit and scope of this invention.

Having thus described the invention, what is desired to be protected by Letters Patent is presented in the subsequently appended claims.

What is claimed is:

1. A scoring apparatus for placing a substantially uniform score line in a piece of cove molding, comprising:

an elongated frame for movably supporting a router having a bit for scoring a line in a piece of cove molding, said router being slidable with respect to said frame in order to traverse said piece of cove molding and score said line;

pivot means carried by said elongated frame for pivoting said router between an inoperative position and a scoring position;

biasing means for biasing said elongated frame with respect to said piece of cove molding; and height adjustment means supported by said elongated frame for adjusting the height of said router with respect to said piece of cove molding.

2. The scoring apparatus in accordance with claim 1, further comprising a base for supporting said router, and means defining a pair of slots disposed in said elongated frame in which said base can slide, whereby said router is slidable with respect to the frame.

3. The scoring apparatus in accordance with claim 2, wherein said height adjustment means further comprises a sheath disposed about said router and supported upon said base, said sheath having means defining a slot, and a turn screw for tightening a position of said router within said sheath, and with respect to said piece of cove molding.

4. The scoring apparatus in accordance with claim 1, further comprising a table for supporting said elongated frame, and wherein said biasing means further comprises a pair of coil springs attached to a pivotal end of said elongated frame and said table.

5. A scoring apparatus for placing a substantially uniform score line in a piece of material, comprising:

a frame for movably supporting a router having a bit for scoring a line in a piece of material, said router being slidable with respect to said frame in order to traverse said piece of material and score said line;

pivot means carried by said elongated frame for pivoting said router between an inoperative position and a scoring position;

biasing means for biasing said frame with respect to said piece of material; and height adjustment means supported by said frame for adjusting the height of said router with respect to said piece of material.

6. The scoring apparatus in accordance with claim 5, further comprising a base for supporting said router, and means defining a pair of slots disposed in said frame in which said base can slide, whereby said router is slidable with respect to the frame.

7. The scoring apparatus in accordance with claim 6, wherein said height adjustment means further comprises a sheath disposed about said router and supported upon said base, said sheath having means for fixing a position of said router within said sheath, and with respect to said piece of material.

8. The scoring apparatus in accordance with claim 5, further comprising a table for supporting said frame, and wherein said biasing means further comprises a pair of coil springs attached to a pivotal end of said frame and said table.

* * * * *